US008091542B2

(12) United States Patent
Hu

(10) Patent No.: US 8,091,542 B2
(45) Date of Patent: Jan. 10, 2012

(54) ELECTRIC TOY GUN WITH A POWER BREAK CONTROL MECHANISM

(76) Inventor: Shih-Che Hu, Yung Kang (TW)

( * ) Notice: Subject to any disclaimer, the term of this patent is extended or adjusted under 35 U.S.C. 154(b) by 0 days.

(21) Appl. No.: 12/876,261

(22) Filed: Sep. 7, 2010

(65) Prior Publication Data

US 2011/0283984 A1 Nov. 24, 2011

(30) Foreign Application Priority Data

May 21, 2010 (TW) ..... 99209606 U

(51) Int. Cl.
*F41B 11/00* (2006.01)

(52) U.S. Cl. ..... 124/77

(58) Field of Classification Search ..... 124/32, 124/45, 77; 42/70.02
See application file for complete search history.

(56) References Cited

U.S. PATENT DOCUMENTS 4,512,100 A * 4/1985 Dheur ..... 42/70.05
5,165,383 A * 11/1992 Ebert et al. ..... 124/74
5,771,875 A * 6/1998 Sullivan ..... 124/72
2002/0152660 A1* 10/2002 Fluhr ..... 42/70.02

* cited by examiner

*Primary Examiner* — Troy Chambers
(74) *Attorney, Agent, or Firm* — Raymond Y. Chan; David and Raymond Patent Firm

(57) ABSTRACT

An electric toy gun having therein a power break control mechanism consisting of an actuator, a power break control set and a swinging block for breaking off power supply upon triggering of the trigger when the clip is empty. When the clip is empty and when the trigger is pressed, the actuator is forced by a spring-loaded lift rod at the bullet outlet of the clip to move the swinging block and the power break control set, causing a power break holder to be moved away from a power contact holder, and therefore power supply is disconnected, avoiding waste of power supply and component damage.

6 Claims, 10 Drawing Sheets

ELECTRIC TOY GUN WITH A POWER BREAK CONTROL MECHANISM

BACKGROUND OF THE PRESENT INVENTION

1. Field of Invention

The present invention relates to toy gun power control technology and more particularly, to a power break control mechanism used in an electric toy gun that interrupts power supply when the clip is empty and when the trigger is pressed.

2. Description of Related Arts

The driving principle of an electric toy gun is completely different from that of an air-soft toy gun. When the trigger of an electric toy gun is pressed, a power break holder is moved into contact with a power contact holder in the inside of the gun body to start the firing mechanism. When firing, a battery-operated gearwheel set 10 is driven to move a piston set 30 toward the rear side in the gun body 20 (see FIG. 1). The piston set 30 has a return spring 301 loaded thereon. When rotating the gearwheel set 10 to a predetermined position, the piston set 30 is released from the gearwheel set 10, and the return spring 301 immediately returns the piston set 30 forwards to its former position, allowing discharge of a compressed gas to drive a toy bullet out of the gun barrel. Thus, one firing action is done, and the toy gun is reset for a next firing action.

When wishing to fire toy bullets repeatedly, the aforesaid firing action is repeated. The power break holder will be moved away from the power contact holder to break off power supply only when the trigger is released. If the clip is empty and the trigger is kept pressed, the gearwheel set 10 and the piston set 30 are kept moving forwards and backwards, and the operator can know the situation only when no toy bullet is fired. It is nonsense to keep the gearwheel set 10 and the piston set 30 moving when the clip is empty. This condition wastes power supply, and may cause component damage. Therefore, an improvement in this regard is necessary.

SUMMARY OF THE PRESENT INVENTION

The present invention has been accomplished under the circumstances in view. It is therefore the main object of the present invention to provide an electric toy gun having therein a power break control mechanism that breaks power supply when the clip is empty and when the trigger is pressed, avoiding waste of power supply and component damage.

To achieve this and other objects of the present invention, an electric toy gun comprises a power break control mechanism, a gearwheel set, a power break holder, a power contact holder, a trigger and a clip, the trigger having a protrusion adapted for moving the power break holder forwardly into contact with the power contact holder and connecting power supply to rotate the gearwheel set when the trigger is pressed, the power break holder being spring loaded for automatic return after having been moved forwards, the clip having a bullet outlet, a lift rod pivotally connected to a part thereof near the bullet outlet and a spring member loaded on the lift rod and imparting an upward biasing force to the lift rod, the power break control mechanism being adapted to break off power supply when the trigger is released after each firing action, wherein: the gearwheel set comprises a push rod, the lift rod comprises a side protrusion; the power break control mechanism comprises an actuator, a power break control set and a swinging block; the spring member biases the lift rod of the clip upwards to force the side protrusion against the actuator, moving the actuator to a position above the power break control set and below a front end of the swinging block when the clip is empty, so that when the gearwheel set is rotated to force the push rod thereof against a rear end of the swinging block, the swinging block is forced to move the power break control set in moving the power break holder away from the protrusion of the trigger for enabling the power break holder to be biased backwards to break off power supply.

Further, the gearwheel set comprises a first gearwheel carrying the push rod of the gearwheel set; the swinging block is spring loaded for automatic return, having a pivot hole coupled to a pivot inside the electric toy gun for enabling the swinging block to be turned about the pivot.

Further, the actuator comprises a curved rod and a movable rod, the curved rod having a rear end pivotally connected to a front end of the movable rod; when the lift rod is moved upwards to force the side protrusion thereof against the actuator, a front end of the curved rod is forced by the side protrusion of the lift rod, causing the movable rod to be moved backwards to the position above the power break control set and below the front end of the swinging block; when the swinging block is pressed on the actuator, the movable rod of the actuator is forced downwards by the swinging bloc; the actuator is returned to the former position when the side protrusion of the lift rod is kept away from the curved rod of the actuator.

Further, the power break control set comprises a swivel rod and a power break control block, the swivel rod being disposed at a bottom side relative to the power break control block, the swivel rod being spring-loaded and normally kept in a backward position, the power break control block being spring-loaded and normally kept in a forward position, the swivel rod having a front end portion, a rear end portion and a top end portion, the power break control block having a push portion and a retaining portion; when the movable rod of the actuator is kept away from the swinging block, the retaining portion of the power break control block is stopped against the top end portion of the swivel rod; when the swinging block is pressed on the movable rod of the actuator, the movable rod is pressed on the front end portion of the swivel rod, and the rear end portion of the swivel rod is turned upwards to push the power break holder away from the protrusion of the trigger, thereby breaking off power supply and enabling the retaining portion of the power break control block to be positioned on the top end portion of the swivel rod.

Further, the power break holder comprises a stop rod; when the rear end portion of the swivel rod is turned upwards, the stop rod of the power break holder is pushed by the rear end portion of the swivel rod, causing movement of the power break holder.

Further, when the push portion of the power break control block is turned backwards, the retaining portion of the power break control block is disengaged from the top end portion of the swivel rod and pressed on the top end portion of the swivel rod.

DETAILED DESCRIPTION OF THE PREFERRED EMBODIMENT

Figure 1:
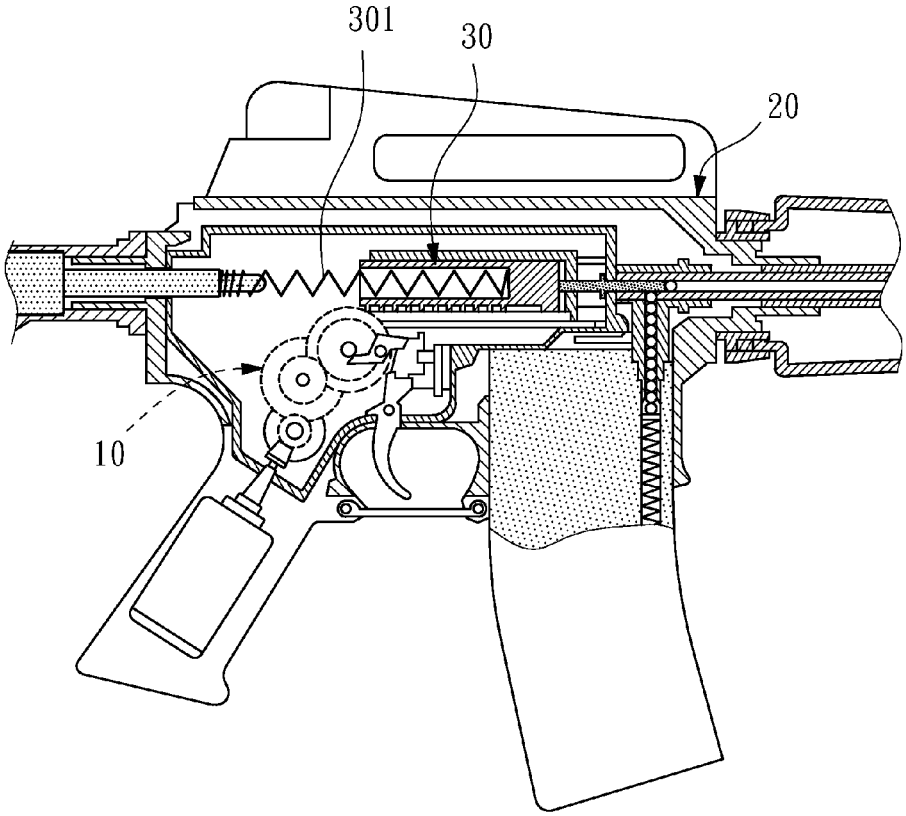
FIG. 1(PRIOR ART)
FIG. 1 is a schematic drawing illustrating the driving mechanism of a conventional electric toy gun.
Figure 2:
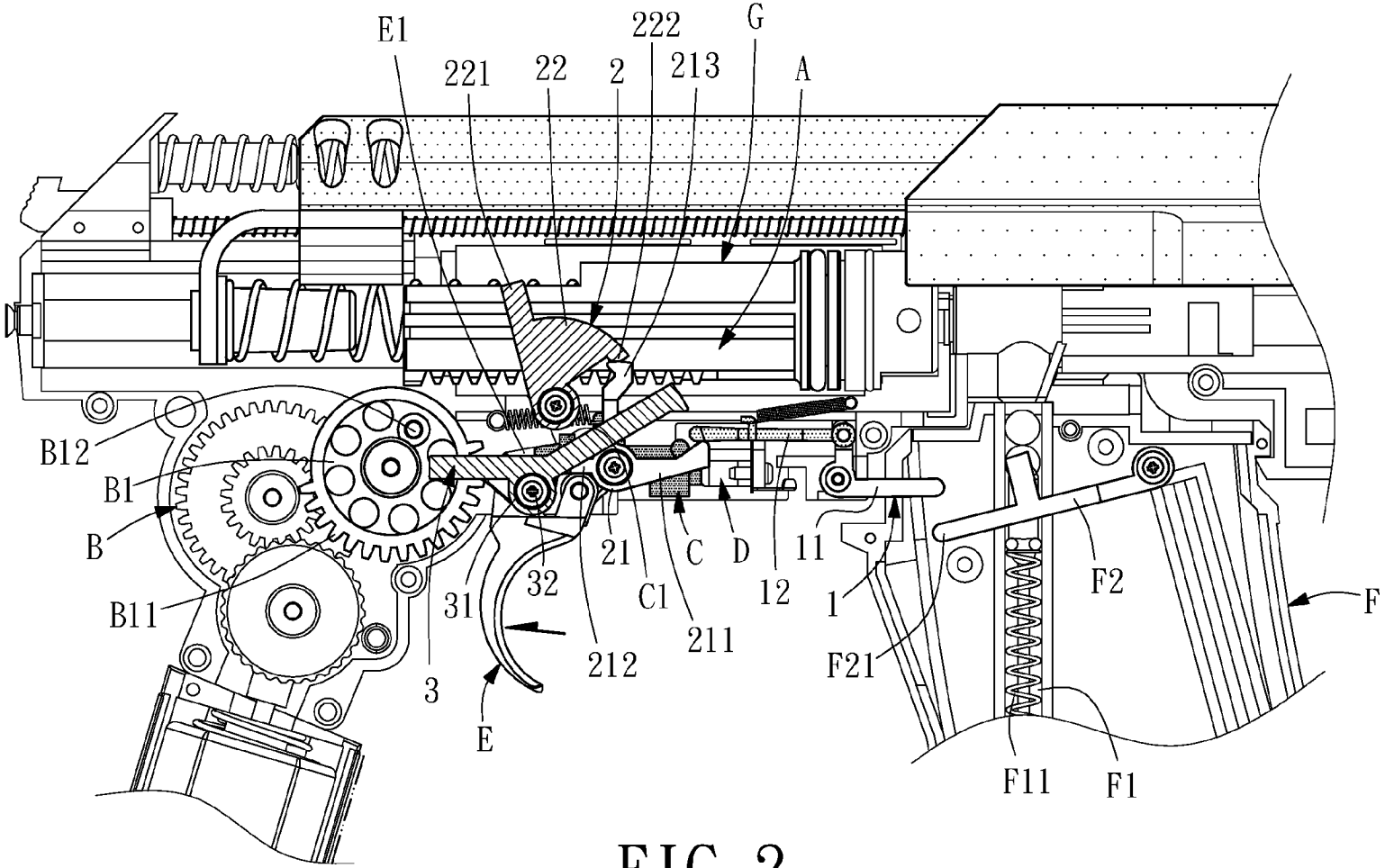
FIG. 2 is a schematic plain view of a part of an electric toy gun embodying the present invention (the clip has toy bullets therein).
Figure 3:
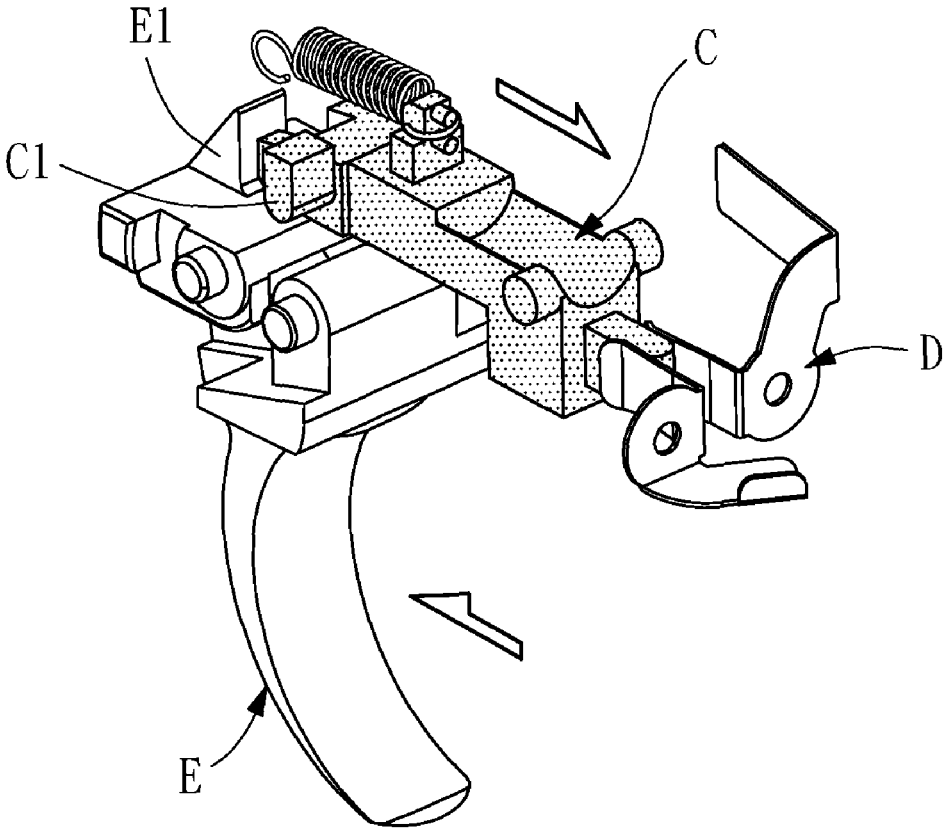
FIG. 3 is a schematic view of a part of the present invention, illustrating the trigger pressed and the power break holder forced into contact with the power contact holder.
Figure 6:
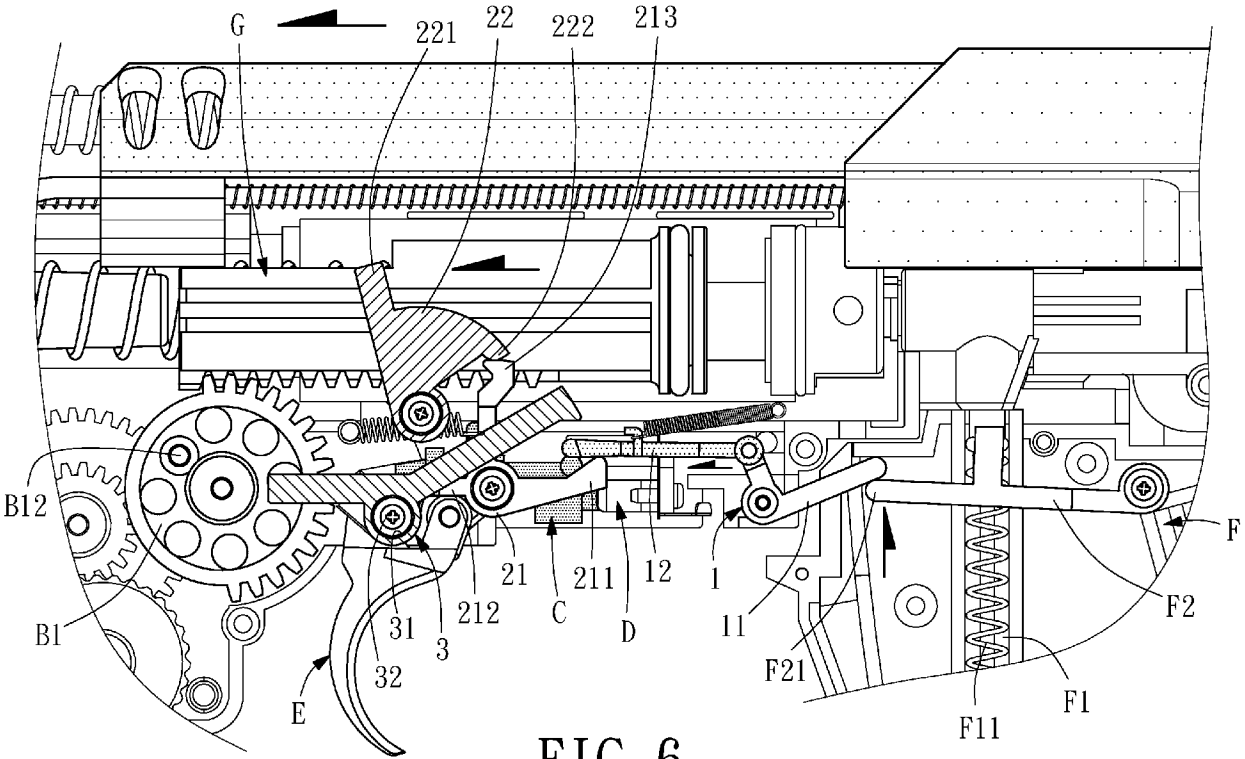
FIG. 6 is a schematic plain view of the present invention, illustrating the status of the power break control mechanism when the clip is empty.

Referring to FIG. 2, a power break control mechanism A is shown installed in the gun body of an electric toy gun. The electric toy gun comprises a gearwheel set B, a power break holder C, a power contact holder D, a trigger E and a clip F (see FIGS. 3 and 4 for the power break holder C and the power contact holder D). The gearwheel set B includes a first gearwheel B1 having a gear sector B11 for moving a piston set G. The first gearwheel B1 further has a push rod B12. The trigger E has a protrusion E1. When pressed the trigger E, the protrusion E1 is forced to move the power break holder C forwardly into contact with the power contact holder D, thereby connecting power supply (see FIG. 3) and rotating the gearwheel set B. Further, the power break holder C can be returned to its former position automatically. Further, the power break holder C is reversible, and has a stop rod C1 (see FIG. 4). Further, the clip F comprises a bullet outlet F1, a lift rod F2 pivotally connected to a part thereof near the bullet outlet F1, and a spring member F11 loaded on the lift rod F2 and imparting an upward biasing force to the lift rod F2. The lift rod F2 has a side protrusion F21. When the bullet outlet F1 receives no bullet, the spring member F11 is returned to its former shape to move the lift rod F2 to the position where the side protrusion F21 extends upwards (see FIG. 6).

The power break control mechanism A comprises an actuator 1, a power break control set 2 and a swinging block 3 (see FIG. 2).

The actuator 1 comprises a curved rod 11 and a movable rod 12. The curved rod 11 has its rear end pivotally connected to the front end of the movable rod 12. When the bullet outlet F1 is empty, the lift rod F2 is moved upwards to force the side protrusion F21 against the front end of the curved rod 11 of the actuator 1, thereby moving the movable rod 12 backwards (see FIG. 6). Further, when the side protrusion F21 is kept away from the curved rod 11 of the actuator 1 (i.e., after loading of a new clip to replace the empty clip), the lift rod F2, the curved 11 and the movable rod 12 are returned to their former positions.

Figure 4:
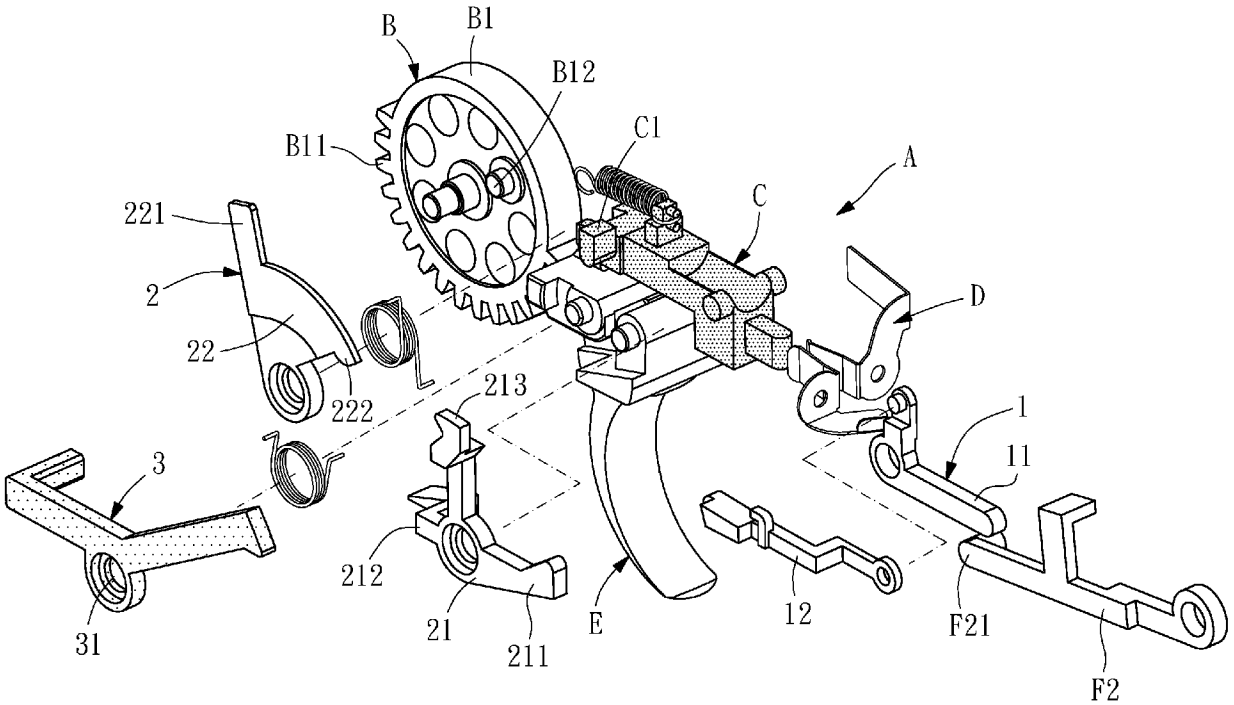
FIG. 4 is an exploded view of the power break control mechanism according to the present invention.
Figure 5:
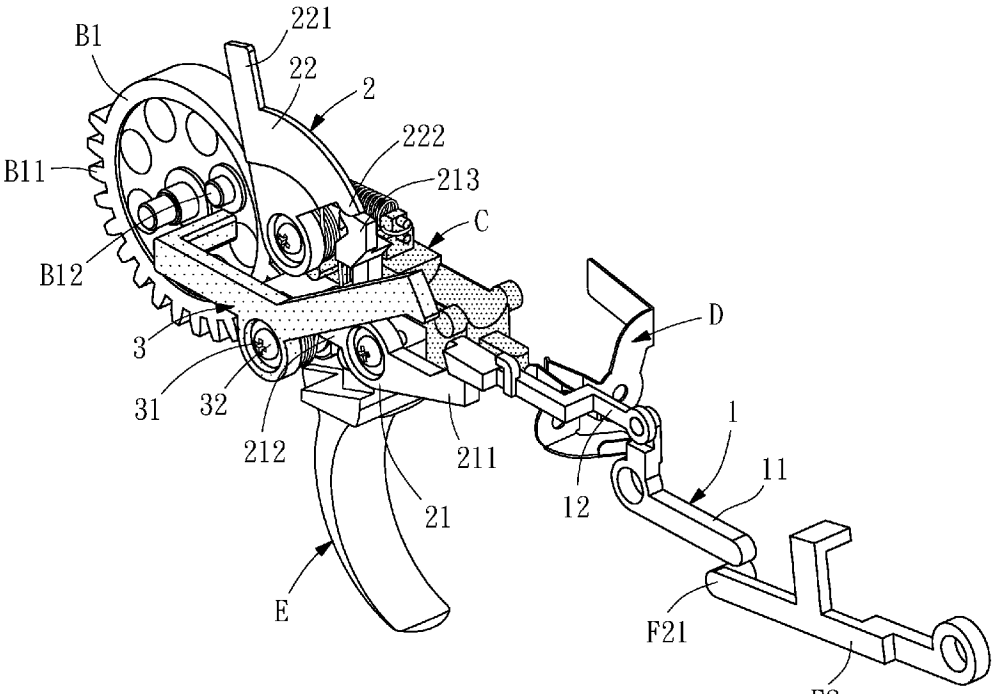
FIG. 5 is an elevational assembly view of FIG. 4.
Figure 8:
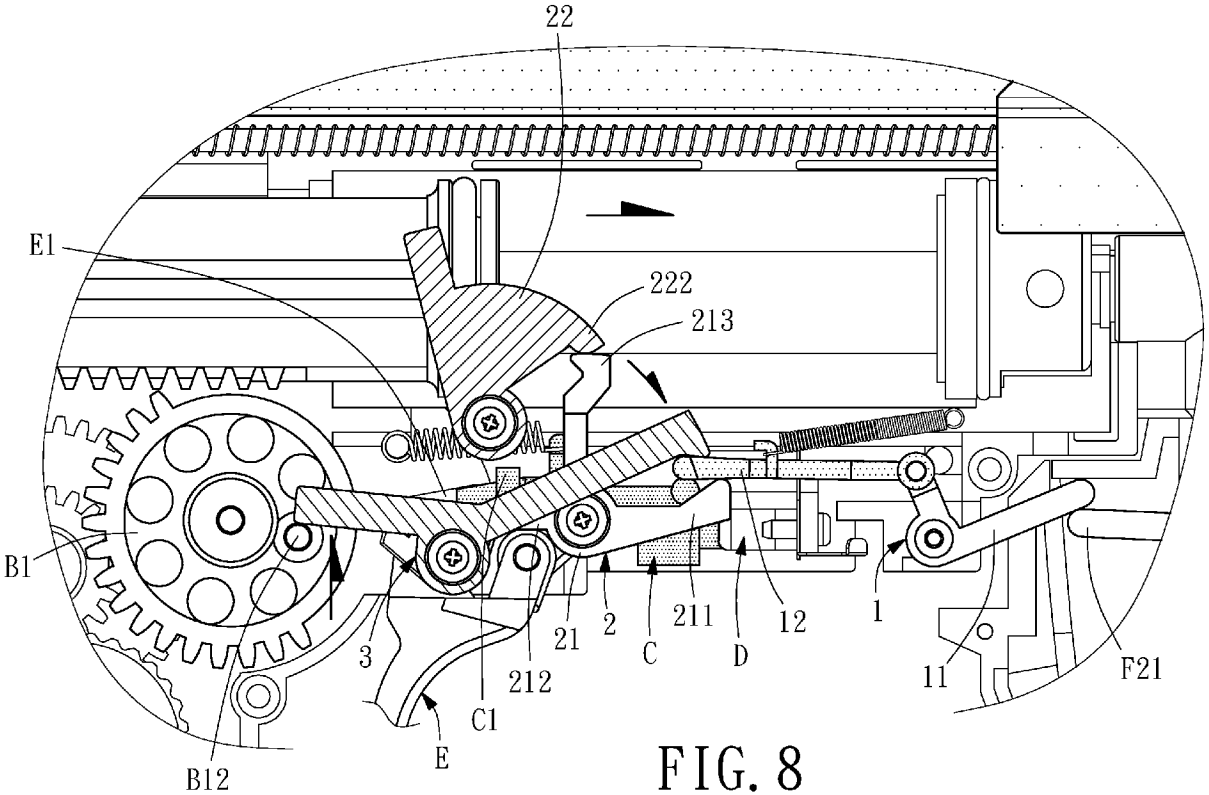
FIG. 8 is a schematic drawing of the present invention, illustrating the swinging block turned downwards, the movable rod pressed on the front end portion of the swivel rod (II).
Figure 9:
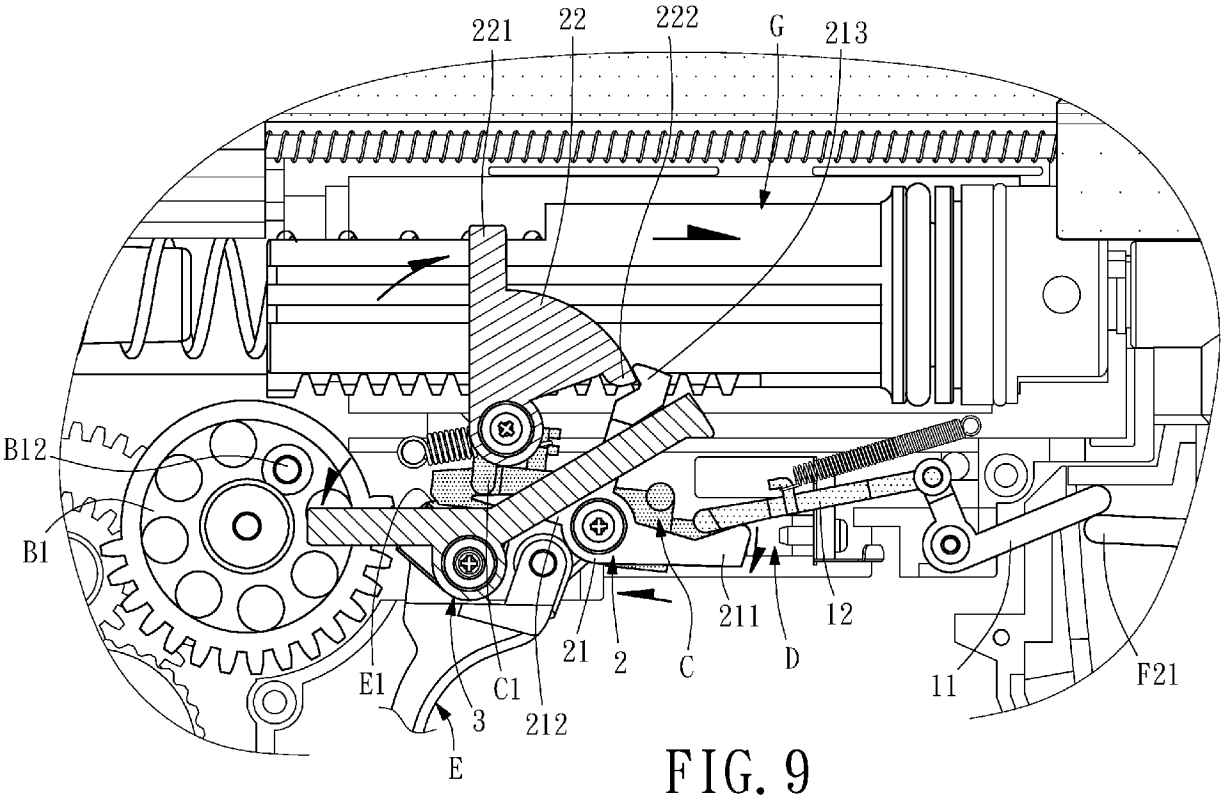
FIG. 9 is a schematic drawing of the present invention, illustrating the rear end portion of the swivel rod moved upwards against the stop rod of the holder block.

The power break control set 2 comprises a swivel rod 21 and a power break control block 22 (see FIGS. 4 and 5). The swivel rod 21 is a triple end member disposed at a bottom side relative to the power break control block 22. The swivel rod 21 is spring-loaded and normally kept in a backward position. The power break control block 22 is spring-loaded and normally kept in a forward position. The swivel rod 21 has a front end portion 211, a rear end portion 212 and a top end portion 213. The power break control block 22 has a push portion 221 and a retaining portion 222. When the power break control set 2 is not moved by the swinging block 3, the swivel rod 21 and the power break control block 22 are kept in balance (see FIGS. 5 and 6), and the retaining portion 222 of the power break control block 22 is pressed on the top end portion 213 of the swivel rod 21. When the swinging block 3 is biased to move the power break control set 2 (see FIG. 8), the front end portion 211 of the swivel rod 21 is forced downwards (see FIG. 9), and the rear end portion 212 of the swivel rod 21 is forced upwards to push the stop rod C1 of the power break holder C, moving the power break holder C away from the protrusion E1 of the trigger E to break power supply. At this time, the retaining portion 222 of the power break control block 22 is stopped at the top end portion 213 of the swivel rod 21, keeping power off.

Figure 7:
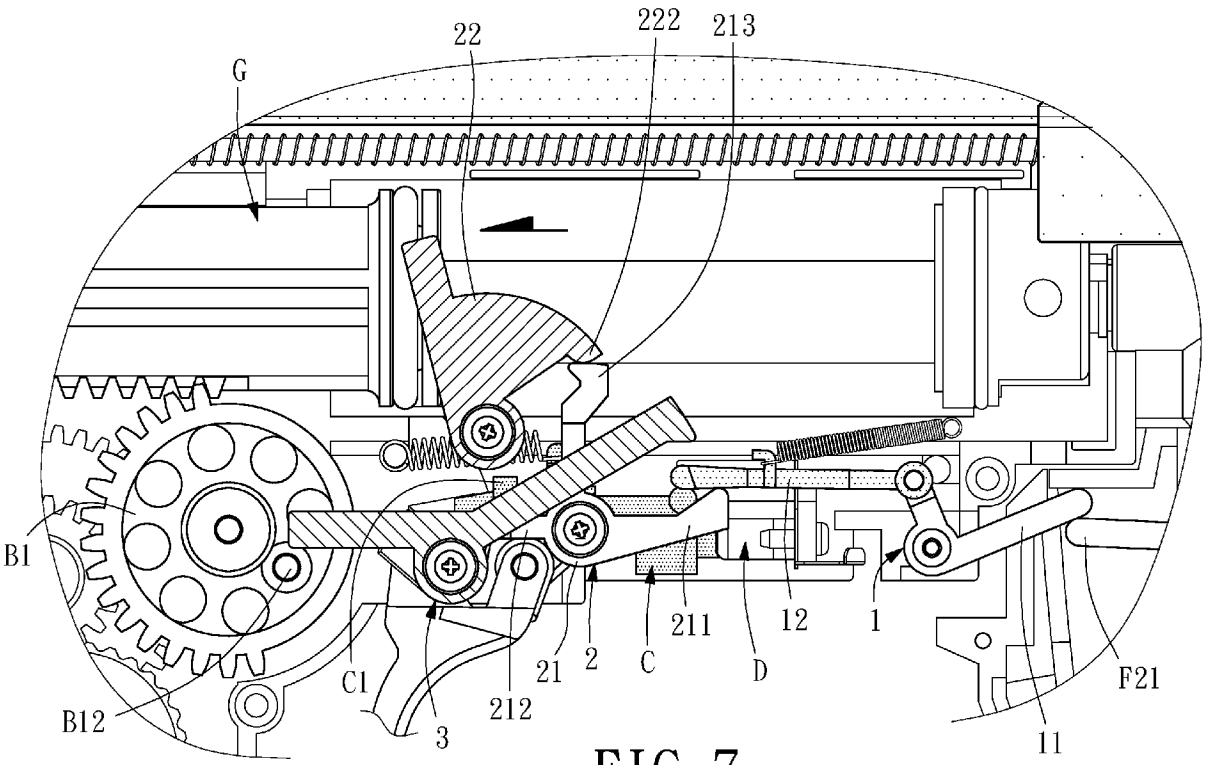
FIG. 7 is a schematic drawing of the present invention, illustrating the swinging block turned downwards, the movable rod pressed on the front end portion of the swivel rod (I).

The swinging block 3 has a pivot hole 31. The pivot hole 31 is pivotally coupled to a pivot 32 that is fixedly mounted in the gun body of the electric toy gun (see FIG. 6). Further, the swinging block 3 is spring loaded for automatic return after having been biased. During rotation of the first gearwheel B1, the push rod B12 biases the swinging block 3 downwards (see FIGS. 7 and 8). When the actuator 1 and the power break control set 2 are not linked with the swinging block 3, the swinging block 3 is turned back and forth by the push rod B12 of the first gearwheel B1 of the gearwheel set B.

When presses the trigger E, the protrusion E1 pushes the power break holder C forwards into contact with the power contact holder D to connect power supply, causing the gearwheel set B to rotate. If the clip F has toy bullets therein at this time, the side protrusion F21 of the spring-loaded lift rod F2 of the clip F will not touch the curved rod 11 of the actuator 1, and the swinging block 3 is turned back and forth by the push rod B12 of the first gearwheel B1 of the gearwheel set B. When all toy bullets have been fired and the clip F is empty, the side protrusion F21 of the spring-loaded lift rod F2 of the clip F will touch and move the curved rod 11 of the actuator 1, causing the movable rod 12 to be moved backwards to the front bottom side of the swinging block 3 above the front end portion 211 of the swivel rod 21 of the power break control set 2, and therefore the rear end of the swivel rod 21 will be lowered to one lateral side of the swinging block 3. When the first gearwheel B1 is rotated to the position where the push rod B12 of the first gearwheel B1 pushes the rear end of the swinging block 21 upwards (see FIGS. 7 and 8), the front end of the swinging block 3 is turned downwards to move the movable rod 12 downwards against the front end portion 211 of the swivel rod 21 (see FIG. 8). At this time, the rear end portion 212 of the swivel rod 21 is turned upwards to push the stop rod C1 of the power break holder C (see FIG. 9), thereby moving the power break holder C away from the protrusion E1 of the trigger E (see also FIG. 3), thus the power break control block 22 is returned to the position where the retaining portion 222 is stopped at the top end portion 213 of the swivel rod 21, and the power supply is kept off (see FIG. 9). Thus, when the clip F is empty, power supply will be automatically broken off.

Figure 10:
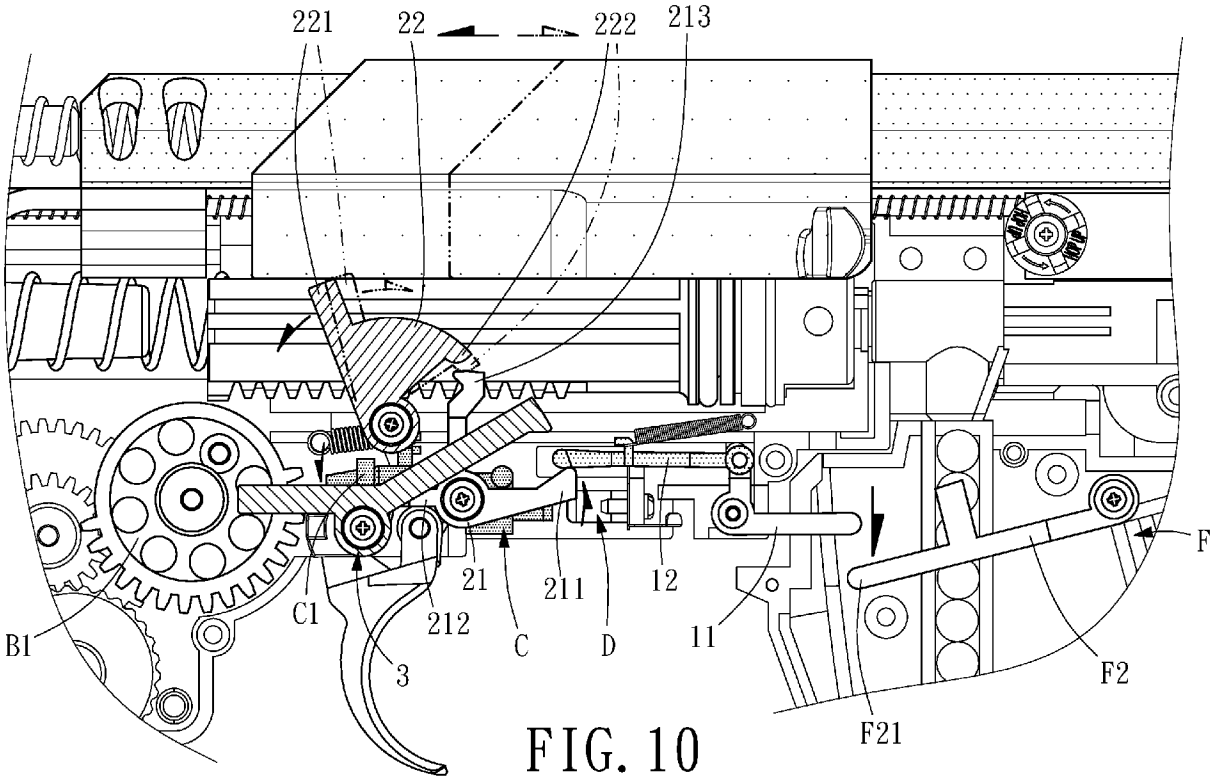
FIG. 10 is a schematic drawing of the present invention, illustrating reset of the power break control mechanism after toy bullets reloaded (replacement of the clip).

Further, when the push portion 221 of the power break control block 22 is moved backwards (see FIG. 10), the retaining portion 222 of the power break control block 22 will be disengaged from the top end portion 213 of the swivel rod 21, for enabling the swivel rod 21 to be returned to its former position. After the swivel rod 21 is returned to its former position, the retaining portion 222 is pressed on the top end portion 213 of the swivel rod 21 again (see FIGS. 9 and 10), for allowing filling of new supply of toy bullets or replacement of the empty clip. Further, when the clip F is removed from the toy gun, the push portion 221 of the power break control block 22 is moved backwards, and the swivel rod 21 is returned to its normal position.

As stated above, the matching arrangement of the power break control mechanism A, the push rod B12, the stop rod C1 and the side protrusion F21 enables the electric toy gun to automatically break off power supply when the clip of the electric toy gun is empty, avoiding power waste and component damage. Thus, the invention effectively eliminates the drawbacks of the prior art design.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. An electric toy gun comprising a power break control mechanism, a gearwheel set, a power break holder, a power contact holder, a trigger and a clip, said trigger having a protrusion adapted for moving said power break holder forwardly into contact with said power contact holder and connecting a power supply to rotate the gearwheel set when said trigger is pressed, said power break holder being spring loaded for automatic return after having been moved forwards, said clip having a bullet outlet, a lift rod pivotally connected to a part thereof near said bullet outlet and a spring member loaded on said lift rod and imparting an upward biasing force to said lift rod, said power break control mechanism being adapted to break off power supply when said trigger is pressed, wherein:

said gearwheel set comprises a push rod, said lift rod comprises a side protrusion;

said power break control mechanism comprises an actuator, a power break control set and a swinging block;

said spring member biases said lift rod of said clip upwards to force said side protrusion against said actuator, moving said actuator to a position above said power break control set and below a front end of said swinging block when said clip is empty, so that when said gearwheel set is rotated to force the push rod thereof against a rear end of said swinging block, said swinging block is forced to move said power break control set in moving said power break holder away from the protrusion of said trigger for enabling said power break holder to be biased backwards to break off a power supply.

2. The electric toy gun as claimed in claim 1, wherein said gearwheel set comprises a first gearwheel carrying the push rod of said gearwheel set; said swinging block is spring loaded for automatic return, having a pivot hole coupled to a pivot inside the electric toy gun for enabling said swinging block to be turned about said pivot.

3. The electric toy gun as claimed in claim 2, wherein said actuator comprises a curved rod and a movable rod, said curved rod having a rear end pivotally connected to a front end of said movable rod; when said lift rod is moved upwards to force the side protrusion thereof against said actuator, a front end of said curved rod is forced by the side protrusion of said lift rod, causing said movable rod to be moved backwards to the position above said power break control set and below the front end of said swinging block; when said swinging block is pressed on said actuator, said movable rod of said actuator is forced downwards by said swinging block; said actuator is returned to the former position when said side protrusion of said lift rod is kept away from said curved rod of said actuator.

4. The electric toy gun as claimed in claim 3, wherein said power break control set comprises a swivel rod and a power break control block, said swivel rod being disposed at a bottom side relative to said power break control block, said swivel rod being spring-loaded and normally kept in a backward position, said power break control block being spring-loaded and normally kept in a forward position, said swivel rod having a front end portion, a rear end portion and a top end portion, said power break control block having a push portion and a retaining portion; when said movable rod of said actuator is kept away from said swinging block, said retaining portion of said power break control block is stopped against the top end portion of said swivel rod; when said swinging block is pressed on said movable rod of said actuator, said movable rod is pressed on said front end portion of said swivel rod, and said rear end portion of said swivel rod is turned upwards to push said power break holder away from the protrusion of said trigger, thereby breaking off power supply and enabling said retaining portion of said power break control block to be positioned on said top end portion of said swivel rod.

5. The electric toy gun as claimed in claim 4, wherein said power break holder comprises a stop rod; when said rear end portion of said swivel rod is turned upwards, said stop rod of said power break holder is pushed by said rear end portion of said swivel rod, causing movement of said power break holder.

6. The electric toy gun as claimed in claim 5, wherein when said push portion of said power break control block is turned backwards, said retaining portion of said power break control block is disengaged from said top end portion of said swivel rod and pressed on said top end portion of said swivel rod.

* * * * *